US006234597B1

(12) United States Patent
Suzuki et al.

(10) Patent No.: US 6,234,597 B1
(45) Date of Patent: May 22, 2001

(54) INK-JET PRINTER WHICH CAN PREVENT A PRINT JOB FROM BEING INTERRUPTED DUE TO INK STORAGE

(75) Inventors: Yasuhiro Suzuki, Numazu; Takuro Ito; Yoshihide Akuzawa, both of Shizuoka-ken; Hitoshi Ushiogi, Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/316,092

(22) Filed: May 24, 1999

(30) Foreign Application Priority Data

May 26, 1998 (JP) ..... 10-143910

(51) Int. Cl.[7] ..... B41J 2/195; B41J 29/393
(52) U.S. Cl. ..... 347/7; 347/19
(58) Field of Search ..... 347/7, 14, 19, 347/6, 84, 85, 86, 87

(56) References Cited

U.S. PATENT DOCUMENTS

| | | | |
|---|---|---|---|
| 4,951,091 | 8/1990 | Nawata . | |
| 5,160,966 | 11/1992 | Shiina et al. . | |
| 5,663,750 | 9/1997 | Sakuma | 347/7 |
| 5,788,388 * | 8/1998 | Cowger et al. | 347/7 |
| 5,860,363 * | 1/1999 | Childers et al. | 347/7 |

FOREIGN PATENT DOCUMENTS

| | | |
|---|---|---|
| 0 443 245 A2 | 8/1991 | (EP) . |
| 0 779 156 A1 | 6/1997 | (EP) . |
| 0 789 322 A2 | 8/1997 | (EP) . |
| 3-5154 | 1/1991 | (JP) . |
| 3-59832 | 9/1991 | (JP) . |
| 7-246712 | 9/1995 | (JP) . |
| 10-138520 | 5/1998 | (JP) . |

* cited by examiner

*Primary Examiner*—John Barlow
*Assistant Examiner*—Juanita Stephens
(74) *Attorney, Agent, or Firm*—Frishauf, Holtz, Goodman, Langer & Chick, P.C.

(57) ABSTRACT

An ink-jet printer includes an ink tank for storing ink, a print head for ejecting the ink supplied from the ink tank to print an image on a paper sheet moved relatively to the print head, an ink-amount sensing section for sensing that ink remaining in the ink tank is decreased to less than a reference amount to generate a sense signal, and a print control circuit for driving the print head such that images are printed on the number of paper sheets ordered by each print job except in a state where the sense signal is generated by the ink-amount sensing section. In particular, the print control circuit is arranged to continue a print job being executed at a time when the sense signal is generated by the ink-amount sensing section.

8 Claims, 7 Drawing Sheets

INK-JET PRINTER WHICH CAN PREVENT A PRINT JOB FROM BEING INTERRUPTED DUE TO INK STORAGE

BACKGROUND OF THE INVENTION

The present invention relates to an ink-jet printer for printing an image on a print medium with ink ejected from a print head and particularly, to an ink-jet printer in which ink is supplied to a print head through a tube from an ink tank.

A serial ink-jet printer has heretofore prevailed. The serial ink-jet printer comprises a carriage movable along a guide bar extending across a paper sheet and a print head which is mounted on the carriage and driven as the carriage moves. The print head is mounted on the carriage along with an ink cassette of a relatively small capacity to eject ink supplied from the ink cassette toward the paper sheet. The paper sheet is fed in a direction perpendicular to the guide bar for each carriage movement. In the case where the print head and the ink cassette are moved by the carriage, the print speed is limited and there is a problem in that the capacity of the ink tank cannot be increased due to an influence on a load and inertia of the carriage. Hence, the ink-jet printer is not suitable for obtaining a great number of prints in a short period of time.

For example, Jpn. Pat. Appln. KOKAI Publication No. 10-138520 filed by the applicant of the present application discloses a rotary drum ink-jet printer which can obtain a great number of prints in a short period of time. The ink-jet printer comprises a rotary drum for rotating in one direction and a print head for printing an image on a paper sheet which is held on the rotary drum and moves together with the rotary drum. The print head has a plurality of ink-jet nozzles aligned in a axial direction of the rotary drum to eject ink toward the paper sheet. The ink is supplied via a tube from an ink tank which has a large capacity and is disposed in an open space remote from the print head. Since the rotary drum ink-jet printer does not require movement of the print head, printing can be performed at a speed higher than that of the serial ink-jet printer. In addition, a great number of prints can be obtained for each supplement of ink.

If the amount of remaining ink becomes small, ink is supplemented in both the serial or rotary drum ink-jet printer. Generally, an ink supplement request is issued in the ink-jet printer when the remaining ink reaches less than a reference amount which is slightly larger than that required for obtaining a predetermined number of prints, and printing is stopped when the predetermined number of prints has been obtained after issuance of the request.

However, after printing has been stopped in this way, the printer cannot perform a test printing of a single sheet for checking a layout of an image and its color arrangement, for example. Further, this ink-jet printer cancels a maintenance process after issuance of the ink supplement request, since the maintenance process consumes ink for a purpose other than printing. In the maintenance process, ink is spat to eliminate a disorder of a print head such as unstable ink ejection caused by increase in viscosity of ink or a change in ink characteristics. Thus, print quality may be degraded due to canceling of the maintenance process. If printing is continued without canceling the maintenance process, ink shortage arises during the printing. Such a maintenance process is disclosed, for example, in Jpn. Pat. Appln. KOKOKU Publication No. 3-59832 and Jpn. Pat. Appln. KOKAI Publication No. 3-5154.

The rotary drum ink-jet printer has an advantage that a great number of prints can be obtained within a short period of time. However, an average number of prints continuously obtained for each print job is remarkably varied with the environment in which the printer is used. Therefore, it is difficult to determine from such an average the number of prints to be obtained after issuance of the ink supplement request. In the environment where a print job of continuously obtaining about 50 A4-size prints is frequently ordered, if the predetermined number of prints is determined at a value less than 50, each print job is very likely to be interrupted due to a stop of printing. To the contrary, if the predetermined number of prints is determined at a value more than 50, an ink supplement request is issued earlier in a state where a large amount of ink remains. On the other hand, the printer must be arranged such that printing is stopped before air intrudes into the tube from the ink tank due to consumption of ink, since a significant amount of time and labor is required to remove air from the tube. In a case where the ink-jet printer is shared by a plurality of computers through a network, print jobs for obtaining a great number of prints are frequently ordered by the computers and stacked in the printer. Since the printer must determine the number of prints to be obtained after issuance of the ink supplement request and interruption timing of printing while performing a control for the print jobs, the determination becomes difficult and complicated.

BRIEF SUMMARY OF THE INVENTION

It is an object of the present invention to provide an ink-jet printer which can prevent a print job from being interrupted due to ink shortage.

According to the present invention, there is provided an ink-jet printer which comprises: an ink storage unit for storing ink; a print head for ejecting the ink supplied from the ink storage unit to print an image on a print medium moved relatively to the print head; an ink-amount sensing section for sensing that ink remaining in the ink storage unit is decreased to less than a reference amount to generate a sense signal; and a print control circuit for driving the print head such that images are printed on print media in a number ordered by each print job except in a state where the sense signal is generated by the ink-amount sensing section, wherein the print control circuit includes a continuation section for continuing a print job being executed at a time when the sense signal is generated by the ink-amount sensing section.

With the ink-jet printer, a print job being executed is continued by the continuation section even in a situation where driving of the print head should be suspended due to decrease of the remaining ink. Accordingly, the print job can be prevented from being interrupted.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to an embodiment of the present invention will be described with reference to the accompanying drawings.

Figure 1:
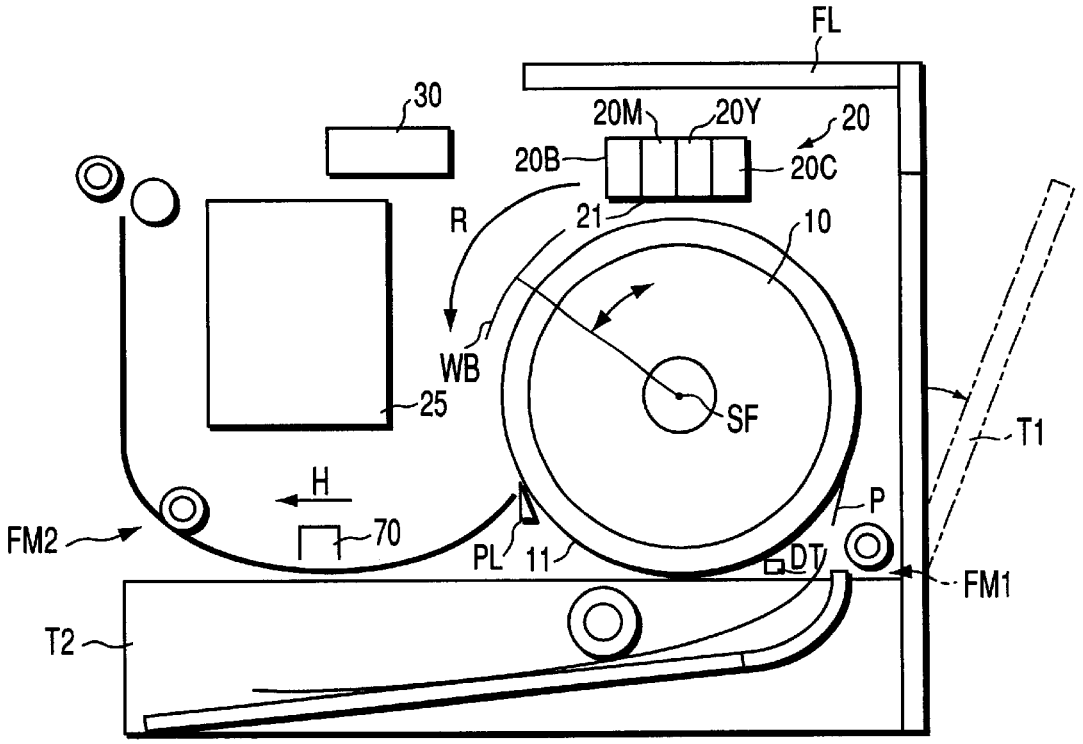
FIG. 1 is a view showing an internal structure of a rotary drum ink-jet printer according to an embodiment of the present invention.

FIG. 1 shows an internal structure of the ink-jet printer. The ink-jet printer is used for performing multicolor printing on a paper sheet P which is cut as a print medium. The paper sheet is, for example, a plain paper sheet or an OHP sheet.

The ink-jet printer includes a rotary drum 10 which rotates in one direction R at a constant circumferential speed while holding a paper sheet P, a print head 20 for performing multicolor printing on the paper sheet P which rotates along with the rotary drum 10, a manual feed tray T1 on which a paper sheet P is placed one by one, a paper cassette T2 for accommodating a stack of paper sheets P, a sheet feed-in mechanism FM1 for feeding the paper sheet P to the rotary drum 10 from the paper cassette T2 and the manual feed tray T1, a sheet feed-out mechanism FM2 for feeding out the paper sheet P which has been printed on the rotary drum 10 to the outside, an ink unit 25 which is disposed to be remote from the print head 20 and supplies inks of four colors to the print head 20, a print control circuit 30 for controlling the whole operation of the ink-jet printer, and a housing FL for accommodating the above described components. The manual feed tray T1 is mounted on the housing FL to be selectively opened or closed and serves as a cover of the housing FL in the closed state.

Figure 3:
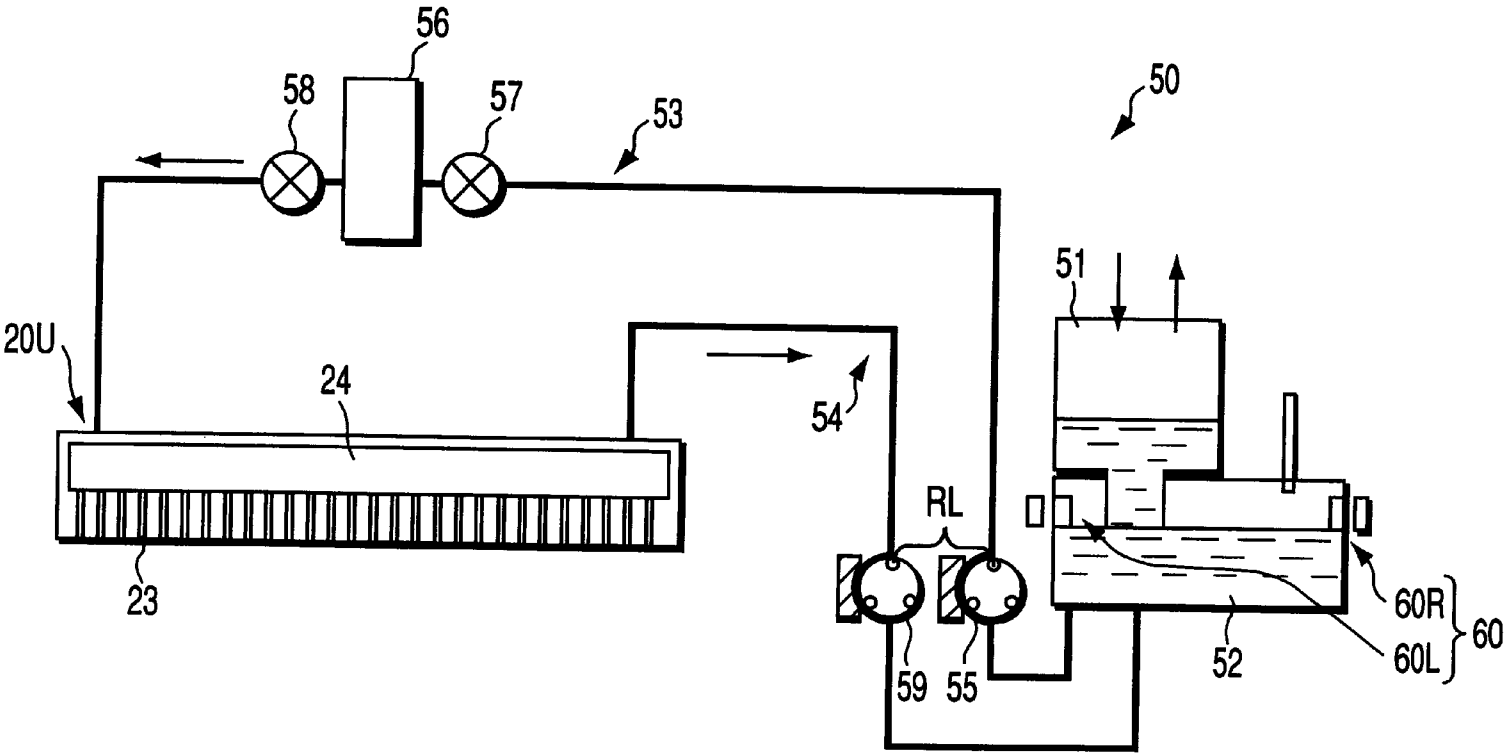
FIG. 3 is a diagram showing an ink supply unit for the ink-jet printer shown in FIG. 1.

The rotary drum 10 is supported rotatably about a shaft SF and winds up and hold the paper sheet P on a peripheral surface 11 thereof by electrostatic attraction. A rotational position of the rotary drum 10 is detected by a rotational position detector DT disposed in the vicinity of the peripheral surface 11 of the rotary drum 10. The print head 20 has 4 nozzle units 20C, 20Y, 20M, 20B, which are arranged in the described order from the upstream side to the downstream side along the peripheral surface 11 of the rotary drum 10, and which respectively perform printing on the paper sheet P in colors of cyan (C), yellow (Y), magenta (M) and black (B). As shown in FIG. 3, each of the nozzle units 20C, 20Y, 20M, 20B includes a plurality of ink-jet nozzles 23 which are arranged in the axial direction of the rotary drum 10 to have a span corresponding to a width of an A4 size paper sheet P and eject ink of a corresponding color to the paper sheet P, and an ink chamber 24 which supplies the ink directly to the ink-jet nozzles 23. The nozzle units 20C, 20Y, 20M, 20B are formed to have the same construction and arranged such that the front ends of the ink-jet nozzles 23 are flush with the end surface of the print head 20.

The sheet feed-in mechanism FM1 takes out a paper sheet from one of the manual feed tray T1 and the paper cassette T2 and feeds the paper sheet P to the rotary drum 10 such that the width direction of the paper sheet P coincides with the axial direction of the rotary drum 10. At this point, the sheet feed-in mechanism FM1 is controlled so as to feed the paper sheet P toward the rotary drum 10 when it is detected by the position detector DT that the rotary drum 10 rotates to a predetermined position. The print head 20 performs color printing on the paper sheet P as the rotary drum 10 rotates. After printing, the paper sheet P is separated from the peripheral surface 11 of the rotary drum 10 by a sheet separating mechanism PL and fed out through an ink drying unit 70 by the sheet feed-out mechanism FM2. The sheet separating mechanism PL is formed of a separating claw which is set in contact with the rotary drum 10 at the time of separation. The paper sheet P passes through the ink drying unit 70 while being fed in the direction indicated by an arrow H in FIG. 1.

Figure 2:
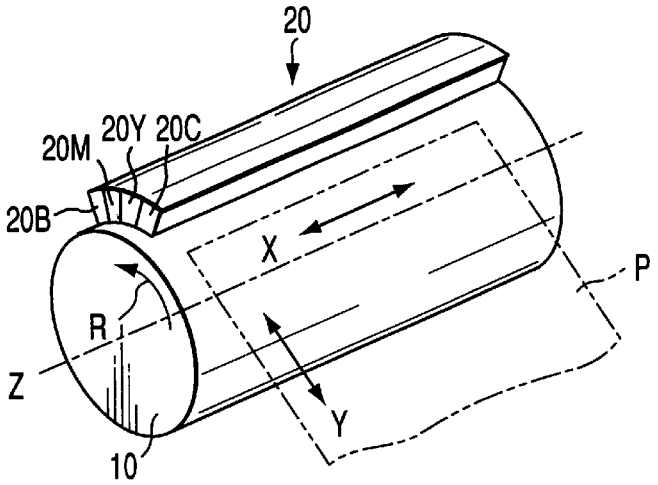
FIG. 2 is a perspective view showing a positional relationship between the rotary drum and the print head shown in FIG. 1.

As shown in FIG. 2, the print head 20 is capable of being slightly shifted forward and backward in a main scanning direction X parallel to the axial direction of the rotary drum 10. The rotary drum 10 holds the paper sheet P wound around the peripheral surface 11, and rotates to move the paper sheet P in a subscanning direction Y perpendicular to the main scanning direction X while facing the nozzle units 20C, 20Y, 20M, and 20B. In the ink-jet printer, for example, an A4 size paper sheet is single color or multicolor printed at a high speed of 20 PPM.

The ink unit 25 includes ink supply sections 50 each of which is assigned to a corresponding one of the nozzle units 20C, 20Y, 20M, 20B, as shown in FIG. 3. The ink supply section 50 includes an ink tank 52 which supports an ink bottle 51 detachably attached thereto and stores ink supplemented from the ink bottle 51, an ink supply tube 53 for guiding the ink from the ink tank 52 to the nozzle unit 20U (=20C, 20Y, 20M, 20B), an ink return tube 54 for guiding the ink from the nozzle unit 20U to the ink tank 52, and an ink-amount sensing section 60 which is attached to the ink tank 52 to sense the amount of ink remaining in the ink tank 52. The ink supply section 50 further includes a supply pump 55, an ink pressure regulator 56, a valve 57, a valve 58; and a return pump 59. The pump 55, the ink pressure regulator 56 and the valves 57, 58 are inserted in the ink supply tube 53 and the return pump 59 is inserted in the ink return tube 54. The pump 55 causes ink to be pumped from the ink tank 52 and flow along the ink supply tube 53. The valves 57 and 58 are inserted in the ink supply tube 53 on both sides of the ink pressure regulator 56 in order to control ink flowing into and from the ink pressure regulator 56. The ink pressure regulator 56 is associated with the valves 57 and 58 to obtain pressure required for discharging or spitting a predetermined amount of ink from the nozzle unit 20U during a maintenance process. The return pump 59 causes excessive ink to be pumped from the nozzle unit 20U and returned to the ink tank 52 along the ink return tube 54.

Each of the ink supply tube 53 and ink return tube 54 comprises an elastic tube of soft synthetic resin. Each of the supply pump 55 and return pump 59 is of a rotary type in which a plurality of press rollers RL are provided at a predetermined interval on a circular locus. These press rollers RL rotate to flow ink in the elastic tube while pressing the tube. Further, each of the pumps 55 and 59 has a valve function of selectively opening and closing the elastic tube. Flow of ink is inhibited when the press rollers RL are stopped at a closing position where the elastic tube is collapsed, and permitted when the press rollers RL are stopped at an opening position where the elastic tube is not collapsed. The press rollers RL of the pumps 55 and 59 are simultaneously driven to fill the ink chamber 24 of the nozzle unit 20U with ink, and stopped respectively at the opening position and closing position to eject ink from the ink-jet nozzles 23 of the nozzle unit 20U.

Figure 4:
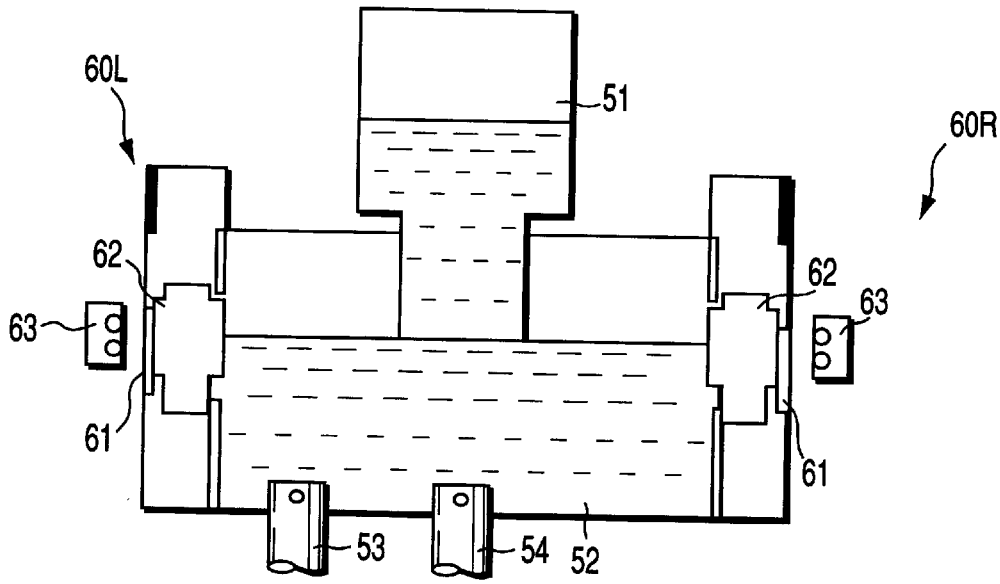
FIG. 4 is a diagram showing a structure of an ink-amount sensing section shown in FIG. 3.

FIG. 4 shows a structure of the ink-amount sensing section 60 attached to the ink tank 52. The ink-amount sensing section 60 includes first and second sensors 60L and 60R which are disposed on both sides of the ink tank 52 to generate a near-empty sense signal by sensing that the remaining ink has been decreased to less than a reference amount required for the number of prints which is predetermined on the basis of a maintenance cycle of the print head 20. Each of the sensors 60L and 60R includes a light transmitting plate 61 which is built in a side surface of the ink tank 52, a float 62 which is arranged adjacent to the light transmitting plate 61 in the ink tank 52 and vertically movable according to the amount of ink remaining in the ink tank 52, and an optical sensor 63 for sensing from a positional change in the float 62 that a liquid level of the ink is decreased below a position a position corresponding to the reference value. The optical sensor 63 is, for example, of a reflection type which has a light emitting element for emitting light to the float 62 through the light transmitting plate 61, and a light receiving element for sensing light reflected by the float 62 and supplied through the light transparent plate 61. In this embodiment, the pair of sensors 60R and 60L are positioned at the same height to commonly sense the reference value. In addition, the sensors 60R and 60L are arranged such that the heights thereof are changeable to apply the case where two reference values should be selectively sensed for performing different processes. On the other hand, since the sensors 60R and 60L are disposed above the bottom of the ink tank 52, as shown in FIG. 4, a near-empty sense signal is generated in a state where the amount of remaining ink falls within a range which does not cause air to intrude into the tube 53. Accordingly, printing can quickly be restarted only by supplementing ink without air removing operation which would be required if air intruded into the tube 53.

Figure 5:
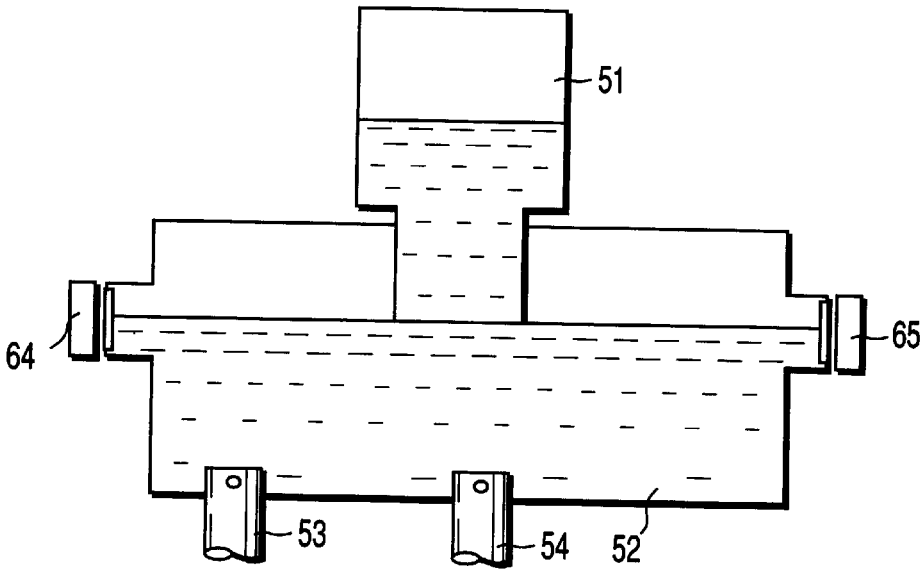
FIG. 5 is a diagram showing a structure of a modification of the ink-amount sensing section shown in FIG. 4.

In addition, the ink-amount sensing section 60 is not limited to the aforementioned structure. For example, sensor section 60 may include a light emitting element 64 and a light receiving element 65 which are respectively disposed on both sides of the ink tank 52, as shown in FIG. 5. In this case, the amount of remaining ink is sensed on the basis of a change in the amount of light emitted from the light emitting element 64 and supplied to the light receiving element 65.

Figure 6:
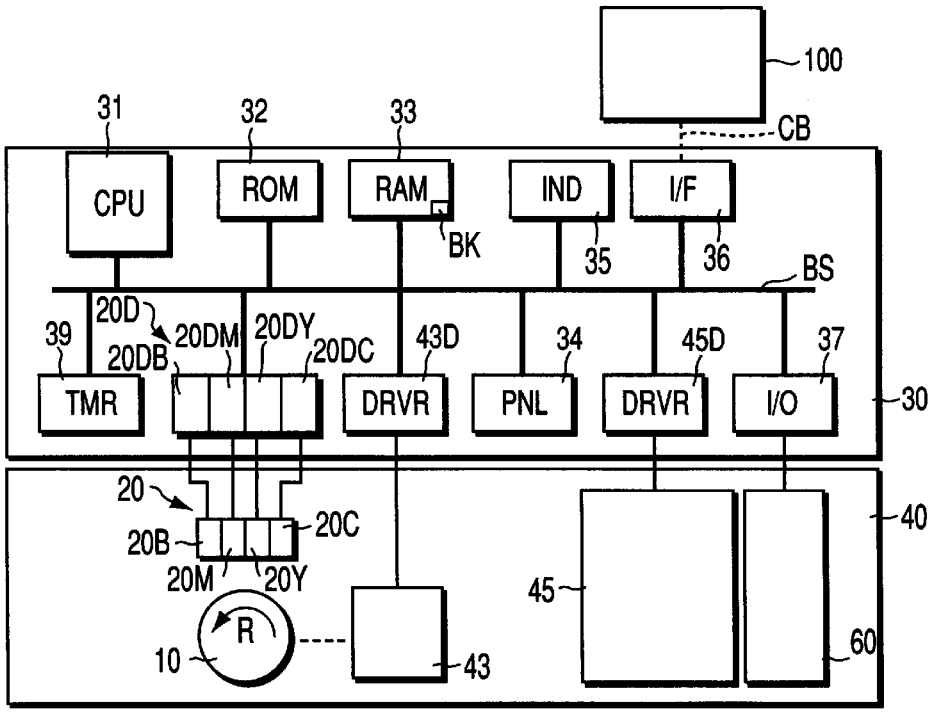
FIG. 6 is a diagram showing a structure of a print control circuit shown in FIG. 1.

FIG. 6 shows a structure of a print control circuit 30. The print control circuit 30 is arranged to perform a control of driving the print head 20, a motor 43 for driving the rotary drum 10 and an engine section 40 including mechanisms 45 other than motor 43 in proper timings and thereby causing an image corresponding to print data to be printed on the paper sheet P with the ink ejected from the print head 20. More specifically, the print control circuit 30 includes a CPU 31 for performing data processings, a ROM 32 for storing a fixed data and a control program of the CPU 31, a RAM 33 for temporarily storing data input to and output from the CPU 31, a control panel (PNL) 34 which is operated to enter variety of instructions and data, an indicator section (IND) 35 for indicating an ink supplement request when the remaining ink is decreased to less than a reference amount, an interface (I/F) 36 which is connected to an external computer 100 via a communication network CB such as a LAN (local Area Network), an input and output port (I/O) 37 connected to the ink-amount sensing section 60, a timer (TMR) 39 driven in synchronism with a detection signal from the rotational position detector DT, head drivers 20DC, 2ODY, 20DM, 20DB for respectively driving the nozzle units 20C, 20Y, 20M, 20B of the print head 20, a motor driver (DRVR) 43D connected to a motor 43 for rotating the rotary drum 10, for example, at 120 rpm, and a mechanism driver (DRVR) 45D connected to various mechanisms other than the motor 43. These components of the print control circuit 30 are interconnected via a system bus BS.

During the above described control, the CPU 31 cooperates with the ROM 32 and the RAM 33 in order to properly perform a process of converting print data supplied in a specific format from the external computer 100 into bit map data or originally producing bit map data by itself. Before start of printing, the CPU 31 selects a print job such as a single-page print job or a multi-page print job, on the basis of control data supplied along with the print data from the external computer. In addition, the print job selected for printing is anytime changeable by key-operation of the control panel 34. The RAM 33 contains a backup memory BK for temporarily storing print data.

The ink-jet printer is arranged to periodically conduct a maintenance process using a washing board WB shown in FIG. 1 in order to prevent clogging in the ink-jet nozzles 23 and perform degassing from the ink-jet nozzles 23, for example. In the maintenance, the print control circuit 30 performs a control of moving the washing board WB along the peripheral surface 11 of the rotary drum 10 such that the washing board WB faces the print head 20 at a non-printing time and forcing a predetermined amount of ink to be discharged or spat from all the ink-jet nozzles 23 toward the washing board WB.

An operation of the print control circuit 30 will be described below. Upon supply of power, the print control circuit 30 performs a process shown in FIG. 7. In step ST10, the print control circuit 30 checks reception of a near-empty sense signal which is generated from the ink-amount sensing section 60 when the ink remaining in the ink tank 52 is decreased to less than the reference amount. When the sense signal has been generated, a print stop mode is selected in step ST11. On the other hand, when the sense signal has not been generated, a print continuation mode is selected in step ST12.

Figure 8:
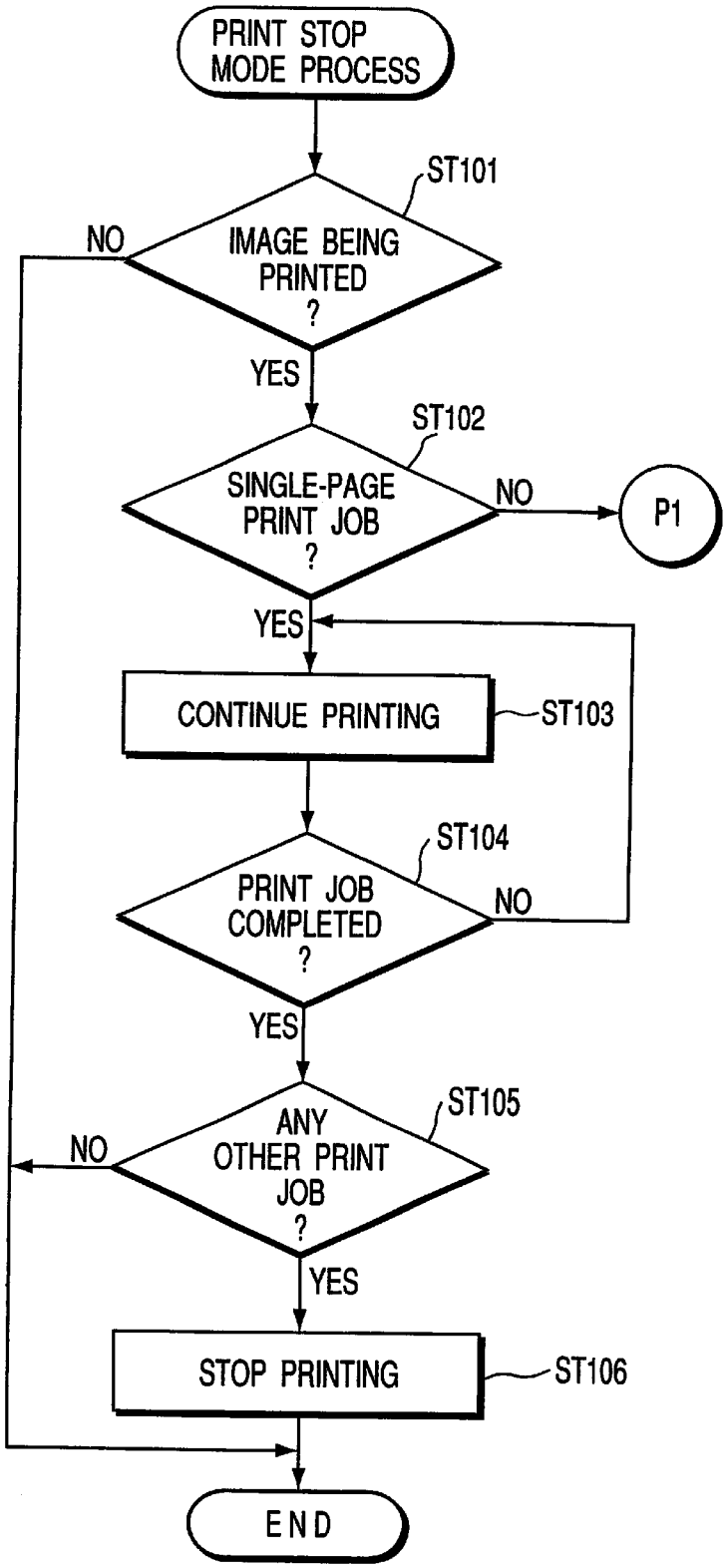
Figure 9:
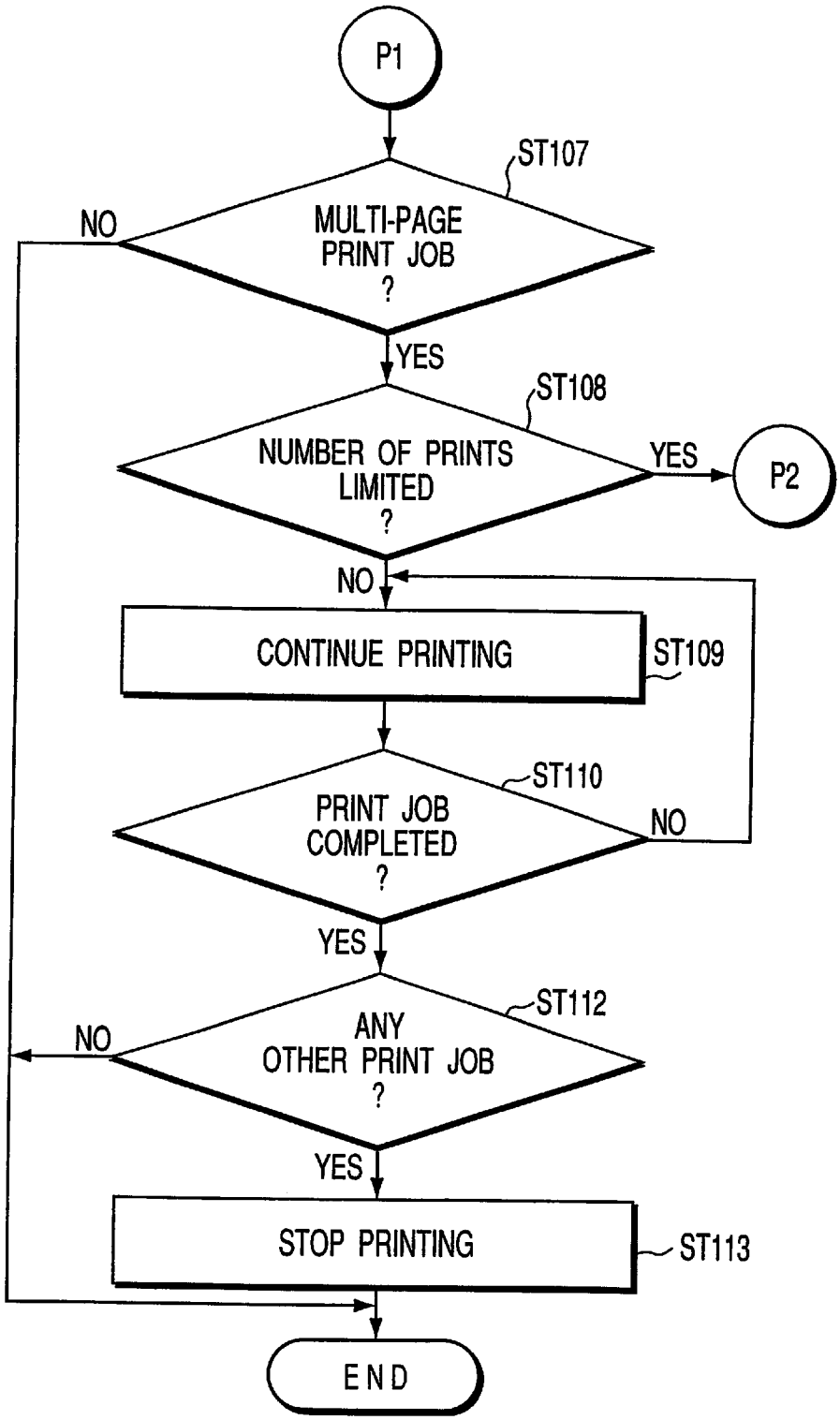
Figure 10:
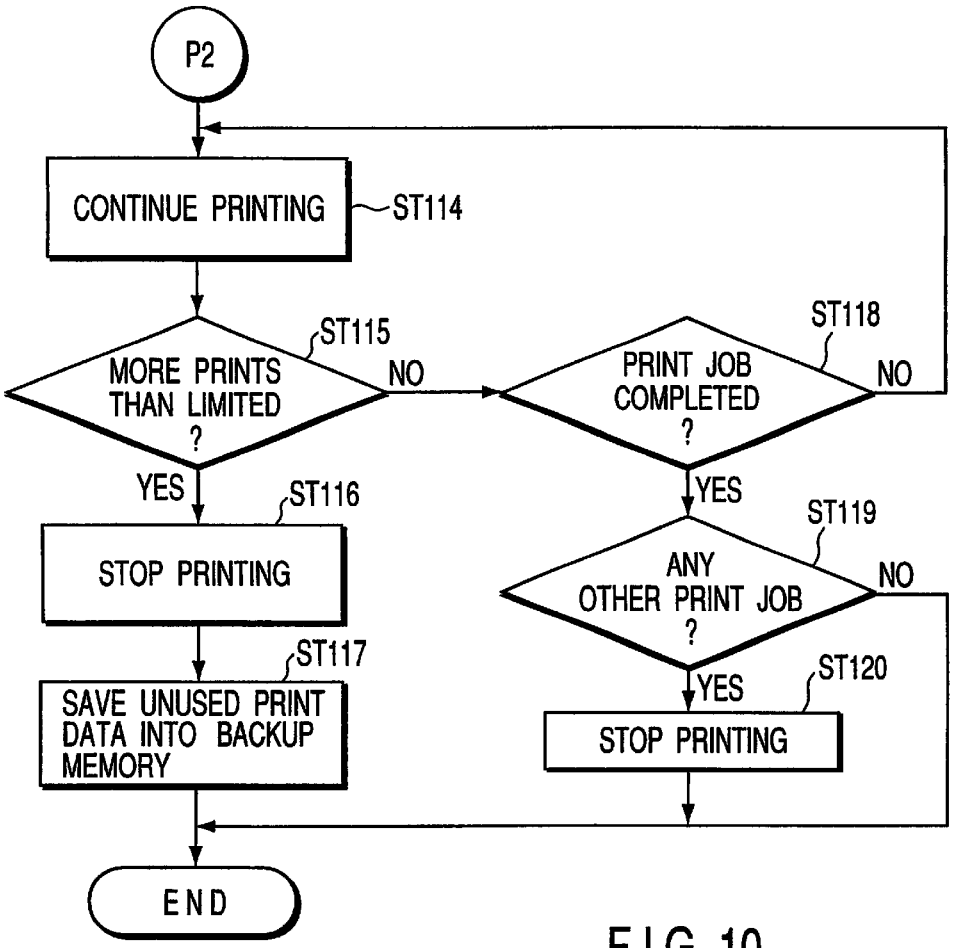

Upon selection of the print stop mode, the print control circuit 30 performs a print stop mode process shown in FIGS. 8 to 10. In this process, if it is confirmed in step ST101 that an image is being printed, step ST102 is executed to check whether the single-page print job is selected. If a single-page print job is detected to be selected the print job is continued in step ST103 and it is checked in step ST104 whether the print job has been completed. If the print job has not been completed, steps ST103 and ST104 are repeated until completion of the print job. If completion of the print job is detected in step ST104, it is confirmed in step ST105 that any other print job does not remain, and the print stop mode process is ended. If any other print job remains, printing is stopped in step ST106 to prevent ink from being ejected from the print head 20 and then the print stop mode process is ended.

If it is detected in step ST102 that single-page print job is not selected, step ST107 is executed to check whether the multi-page print job is selected. If the multi-page print job is selected, step ST108 is executed to check whether the number of prints is limited in advance from necessity for maintenance. If the number of prints is not limited, printing is continued in step ST109 and it is checked in step ST110 whether the multi-page print job has been completed. If the print job has not been completed, steps ST109 and ST110 are repeated untill completion of the print job.

If completion of the print job is detected in step 110, it is confirmed in step ST112 that any other print job does not remain, and the print stop mode process is ended. If any other print job remains, printing is stopped in step ST113 to prevent ink from being ejected from the print head 20 and then the print stop mode process is ended.

If it is detected in step ST108 that the number of prints is limited in advance from necessity for maintenance, printing is continued in step ST114 and step ST115 is executed to check whether or not the number of prints obtained after generation of the near-empty sense signal has exceeded the limited number. If the number of prints has exceeded the limited number, printing is stopped in step ST116 to prevent ink from being ejected from the print head 20, print data which are left unused for the print job interrupted by the stop of printing are saved into the backup memory BK in step ST117, and then the print stop mode process is ended.

If the number of print has not exceed the limited number, step ST118 is executed to check whether the print job has been completed. If the print job has not been completed, steps ST114, ST115, and ST118 are repeated.

If completion of the print job is detected in step ST118, it is confirmed in step ST119 that any other print job does not remain, and the print stop mode process is ended. If any other print job remains, printing is stopped in step ST120 to prevent ink from being ejected from the print head 20 and then the print stop mode process is ended.

Figure 7:
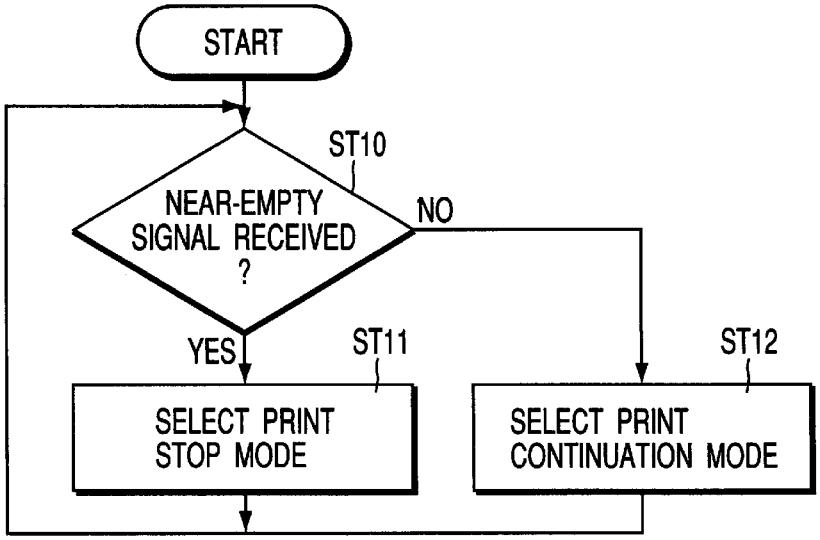
FIG. 7 to FIG. 11 are flow charts for illustrating an operation of the print control circuit shown in FIG. 4.
Figure 11:
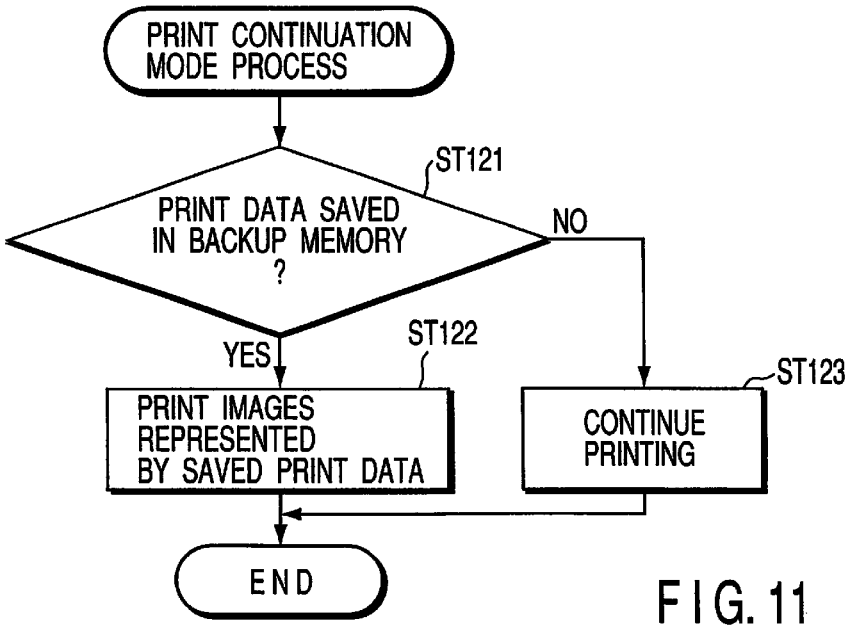

When generation of the near-empty sense signal is stopped by supplement of ink, the print continuation mode is selected in step ST12 of FIG. 7. Thus, the print control circuit 30 performs a print continuation mode process shown in FIG. 11. In the print continuation mode process, the print control circuit 30 checks in step ST121 whether there is print data saved in the backup memory BK of the RAM 33. In the case where a print job has been interrupted by execution of step ST116 of FIG. 10, print data left unused for the print job have been saved into the backup memory BK in step ST117. Thus, images represented by the saved print data is printed in step ST122, and then the print continuation process is ended.

If there is no print data saved in the backup memory BK, current printing of an image is continued in step ST123, and then the print continuation process is ended.

According to the aforementioned embodiment, the CPU 31 of the print control circuit 30 controls to continue a print job being executed at the time when a sense signal is generated from the ink-amount sensing section 60. That is, printing is usually stopped after completion of the print job. The user operability is improved since interruption of the print job is prevented as described above.

Further, in a condition that the number of prints is limited for the reference amount of ink remaining in the ink tank 52, the CPU 31 causes driving of the print head 20 to be stopped when the number of prints obtained by continuation of printing has exceeded the limited number. Although a print job is interrupted, the ink tank 52 can be completely prevented from being empty. Further, since the limited number of prints is determined such that printing is stopped before air intrudes from the ink tank 52 into the ink supply tube 53, a troublesome work for removing air from the tube 53 can be eliminated. On the other hand, in a condition that the number of prints is not limited for the reference amount of ink remaining in the ink tank 52, the CPU 31 causes driving of the print head 20 to be stopped when a print job is completed. In an environment where a small number of prints is ordered in every print job, no air intrudes into the tube 53 even if settings of limiting the number of prints is omitted. Since stable ink ejection can be maintained in a state that the tube 53 has no air intruded therein, print quality is not degraded and a maintenance process of the print head 20 can be assured. Moreover, in a condition that printing of a single sheet is ordered by a print job being executed when the sense signal is generated from the ink-amount sensing section 60, the CPU 31 causes driving of the print head 20 to be stopped upon completion of the print job. Thus, a test printing of a single sheet or the like is not influenced due to decrease of the remaining ink.

In addition, print data required for resuming an interrupted print job are saved into the backup memory BK of the print control circuit 30. Accordingly, this print job can be completed using the print data, immediately after ink is supplemented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

an ink storage unit for storing ink;

an ink supplement member, detachably connected to said ink storage unit, for supplementing ink into said ink storage unit;

a print head for receiving the ink from the ink storage unit and ejecting the ink to print an image on a print medium that is moved relatively to the print head;

an ink-amount sensing section for sensing that an amount of the ink remaining in said ink storage unit is decreased to less than a reference amount to generate a sense signal; and a print control circuit for driving said print head such that images are printed on print media in a number ordered by each print job except in a state where the sense signal is generated by said ink-amount sensing section;

wherein said ink storage unit is connected to said print head by an ink supply tube, and said reference amount to be sensed by said ink-amount sensing section is set such that a limited number of prints are obtainable without any intrusion of air into said ink supply tube from said ink storage unit; and wherein said print control circuit includes a continuation means for continuing a print job being executed at a time when the sense signal is generated by said ink-amount sensing section, using the ink remaining in said ink storage unit at the time when the sense signal is generated by said ink-amount sensing section.

2. An ink-jet printer according to claim 1, wherein said continuation means includes first stop means for causing, in a condition that a number of possible prints is limited for the reference amount of remaining ink, driving of said print head to be stopped when the number of prints obtained by continuation of the print job has exceeded the limited number.

3. An ink-jet printer according to claim 2, wherein said continuation means further includes second stop means for causing, in a condition that a number of possible prints is not limited for the reference amount of remaining ink, driving of said print head to be stopped upon completion of the print job.

4. An ink-jet printer according to claim 3, wherein said continuation means further includes third stop means for causing, in a condition that printing of a single print medium is ordered by the print job being executed when the sense signal is generated by the ink-amount sensing section, driving of said print head to be stopped upon completion of the print job.

5. An ink-jet printer according to claim 2, wherein said print control circuit includes a memory for storing print data required for resuming the print job interrupted when the driving of said print head is stopped by said first stop means.

6. An ink-jet printer according to claim 1, wherein said continuation means includes stop means for causing, in a condition that the number of possible prints is not limited for the reference amount of remaining ink, driving of said print head to be stopped upon completion of the print job.

7. An ink-jet printer according to claim 1, wherein said continuation means includes stop means for causing, in a condition that printing of a single print medium is ordered by the print job being executed when the sense signal is generated by the ink-amount sensing section, driving of said print head to be stopped upon completion of the print job.

8. An ink-jet printer according to claim 1, wherein said ink amount sensing section is provided independently of said print control circuit.

* * * * *